US007481753B2

(12) United States Patent
James et al.

(10) Patent No.: US 7,481,753 B2
(45) Date of Patent: Jan. 27, 2009

(54) ROTATABLE PUSH-UP EXERCISE DEVICE

(76) Inventors: Michael Thomas James, 4544 Brunner Rd., Athol, ID (US) 83801; Michael Todd Hege, 13126 Whitetail Ln, Athol, ID (US) 83801

( * ) Notice: Subject to any disclaimer, the term of this patent is extended or adjusted under 35 U.S.C. 154(b) by 0 days.

(21) Appl. No.: 11/654,536

(22) Filed: Jan. 18, 2007

(65) Prior Publication Data

US 2007/0184951 A1 Aug. 9, 2007

(51) Int. Cl.
*A63B 26/00* (2006.01)

(52) U.S. Cl. ..... 482/140; 482/62

(58) Field of Classification Search ..... 482/141, 482/62

See application file for complete search history.

(56) References Cited

U.S. PATENT DOCUMENTS 4,610,448 A * 9/1986 Hill ..... 482/141
5,713,823 A * 2/1998 Walendzak et al. ..... 482/142
2006/0014615 A1* 1/2006 Godbold ..... 482/141

* cited by examiner

*Primary Examiner*—Lori Amerson

(57) ABSTRACT

The rotatable push-up exercise device provides device for aiding a user in performing push-up type exercises. The device has a platform rotatably mounted on a base. The platform may selectively be held stationary or may be free to rotate when performing push-up exercises. The device includes a gripping bar mounted on the platform. The base is adapted to rest on a support surface, such as the floor. A pair of exercise devices are normally utilized together. In use the user grasps the gripping bar of each device with one hand and performs push-up exercises. Due to the rotation of the support surface with respect to the base, the user is forced to exercise the shoulders and other muscle groups in the user's body, in addition to the arm and chest muscles, in order to maintain a stable position.

1 Claim, 4 Drawing Sheets

ROTATABLE PUSH-UP EXERCISE DEVICE

BACKGROUND OF THE INVENTION

1. Field of the Invention

The present invention relates to an exercise device, and particularly to a rotatable push-up exercise device (typically two devices are used to perform a push-up, the devices being spread apart at shoulder width so that each arm is supported by a separate device) having a platform-mounted bar grasped by, the user when performing push-ups that may be held stationary when performing push-ups, or in which the platform may be free to rotate when performing push-ups.

2. Description of the Related Art

Push-ups are a traditional conditioning exercise for exercising the muscles in the arms and chest of the user. Various devices have been utilized to aid the user in executing push-ups, most being focused on stabilizing the user's body to concentrate force in the user's arms and chest, and further to aid in the prevention of accidental injury. Typical push-up aiding devices provide some sort of base with a gripping handle mounted thereon. One such base and handle is provided for each of the user's hands, and the user performs the push-up exercise gripping the handles, rather than having his or her hands positioned in the traditional position on the floor.

Although such devices aid the user in exercising the user's arms and chest, these devices do not provide the user with the option of either allowing the grips to rotate or keeping the grips stationary. Moreover, when such devices use ball bearings, both the upper and lower races are continuous. A device in which the handgrips are held stationary allows the user to concentrate on strengthening the biceps, since the shoulder muscles are constrained when performing conventional push-ups. A device in which the handgrips rotate exercises other muscle groups, so that muscles that are used in rotating the arms, such as the rotator cuff muscles, shoulder muscles, and small muscles of the arms and wrists are exercised and strengthened. A single device that permits the user both options is desirable. Thus, a rotatable push-up exercise device solving the aforementioned problems is desired.

SUMMARY OF THE INVENTION

The rotatable push-up exercise device is a device for aiding a user in performing push-up type exercises. The device may selectively be used to perform push-up exercises with the devices held stationary in order to exercise the muscles of the user's arms and chest, or may be used in a rotatable mode to perform modified exercises that exercise other muscle groups in the user's body. The device includes a platform having a gripping bar mounted thereon. The gripping bar extends across the upper surface of the platform and is mounted at either end to the upper surface of the platform. Typically, a pair of the devices is provided, one for each hand of the user. Alternatively, the user may utilize a single device, to perform "close grip" push-ups or similar exercises.

The platform is rotatably mounted to a base, which rests on a support surface, such as the floor. A plurality of ball bearings or other antifriction or roller bearings may be disposed between the base and the platform to allow the platform to rotate on the base. The lower surface of the base may include a frictional element, such as a non-slip pad, in order to enhance frictional engagement with the floor.

In use, a pair of the devices are placed on a floor or other support surface, separated by about the width of the shoulders. The user grasps the gripping bar of the devices and performs push-up exercises. Due to the rotation of the platform with respect to the base, the user is forced to exercise other muscle groups in the user's body in order to maintain a stable position. The platform may be selectively locked to the base to perform traditional push-up type exercises. A locking pin is provided, which engages an opening formed through the platform and enters a recess formed in the upper surface of the base, allowing the user to selectively lock the platform in place with respect to the base.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
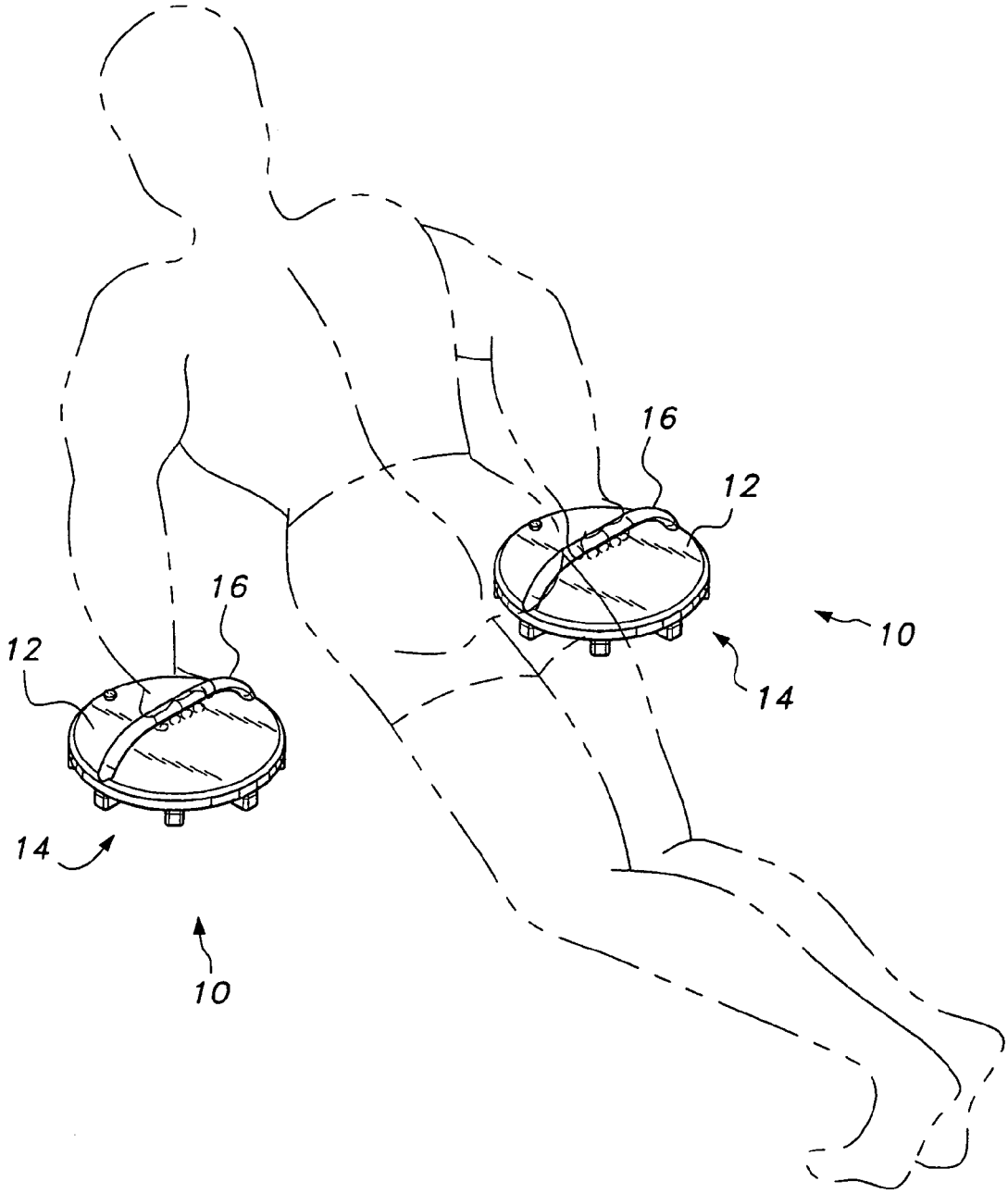
FIG. 1 is an environmental, perspective view showing a pair of rotatable push-up exercise devices according to the present invention in use.

As shown in FIG. 1, the present invention is a rotatable push-up exercise device, referred to generally as 10 in the drawings. The rotatable push-up exercise device 10 includes a platform 12, which is rotatably mounted on a base 14. A gripping bar 16 is mounted on the upper surface of platform 12 and is adapted for grasping by at least one hand of the user, as shown. The user may perform push-up type exercises while in the 5 position shown in FIG. 1. However, the user must exert additional force by exercising muscle groups outside of the user's chest and arms in order to maintain platform 12 in a substantially stable position with respect to base 14. It should be noted that the user preferably utilizes a pair of devices 10, as shown in FIG. 1. However, the user may perform "close-grip" push-ups, 10 or similar exercises, to exercise the "core" muscles by grasping a single gripping bar 16 with both hands.

Platform 12 and base 14 are formed from a rugged and lightweight material, allowing the device 10 to be easily transported and used in a wide variety of environments. One such exemplary material is polycarbonate plastic. However, it should be understood that device 10 may be constructed from any suitable material, such as acrylonitrile-butadiene-styrene (ABS).

Figure 2:
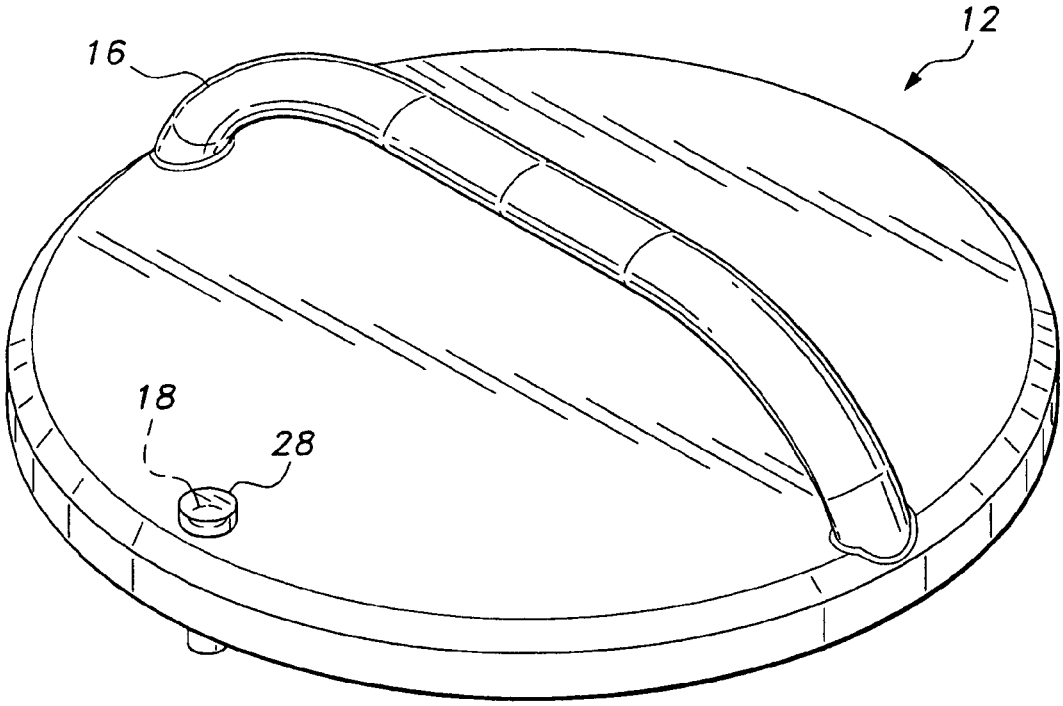
FIG. 2 is a perspective view of a platform of the rotatable push-up exercise device according to the present invention.

As best shown in FIG. 2, in the preferred embodiment the platform 12 has a substantially circular contour. In the preferred embodiment, the platform 12 has a diameter of approximately 10 inches. The size and shape of platform 12, however, are dependent upon the needs and desires of the user. Gripping bar 16 is mounted, at either end, to the upper surface of platform 12, extending diametrically across the platform 12. The opposed ends of gripping bar 16 may be integrally formed with platform 12, or may be mounted through the use of conventional mounting structures, such as brackets, screws, bolts or the like. The central portion of gripping bar 16 is positioned above the upper surface of platform 12 so that the user may grasp the gripping bar 16 with at least one hand, as shown in FIG. 1. Gripping bar 16 may be contoured or padded for optimizing user comfort. Platform 12 further has a passage 18 formed therethrough adjacent the periphery thereof, as will be described in further detail below.

Figure 3:
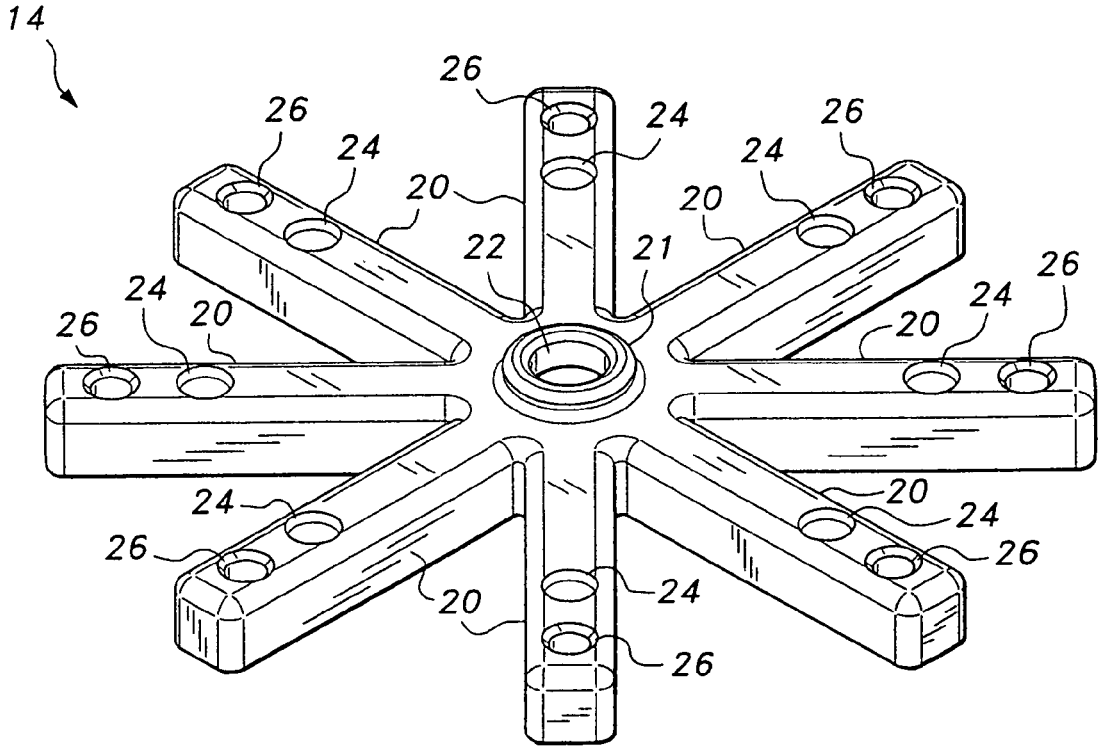
FIG. 3 is a perspective view of a base of the rotatable push-up exercise device according to the present invention as seen from above.

Base 14 may have any suitable contour or configuration. However, as shown in FIG. 3, in a preferred embodiment, base 14 includes a plurality of support arms 20 joined together at a central end to form a hub 21, the arms 20 extending in a substantially radial direction from hub 21. As will be described in further detail below, hub 21 has an opening 22 formed centrally therethrough.

Figure 4:
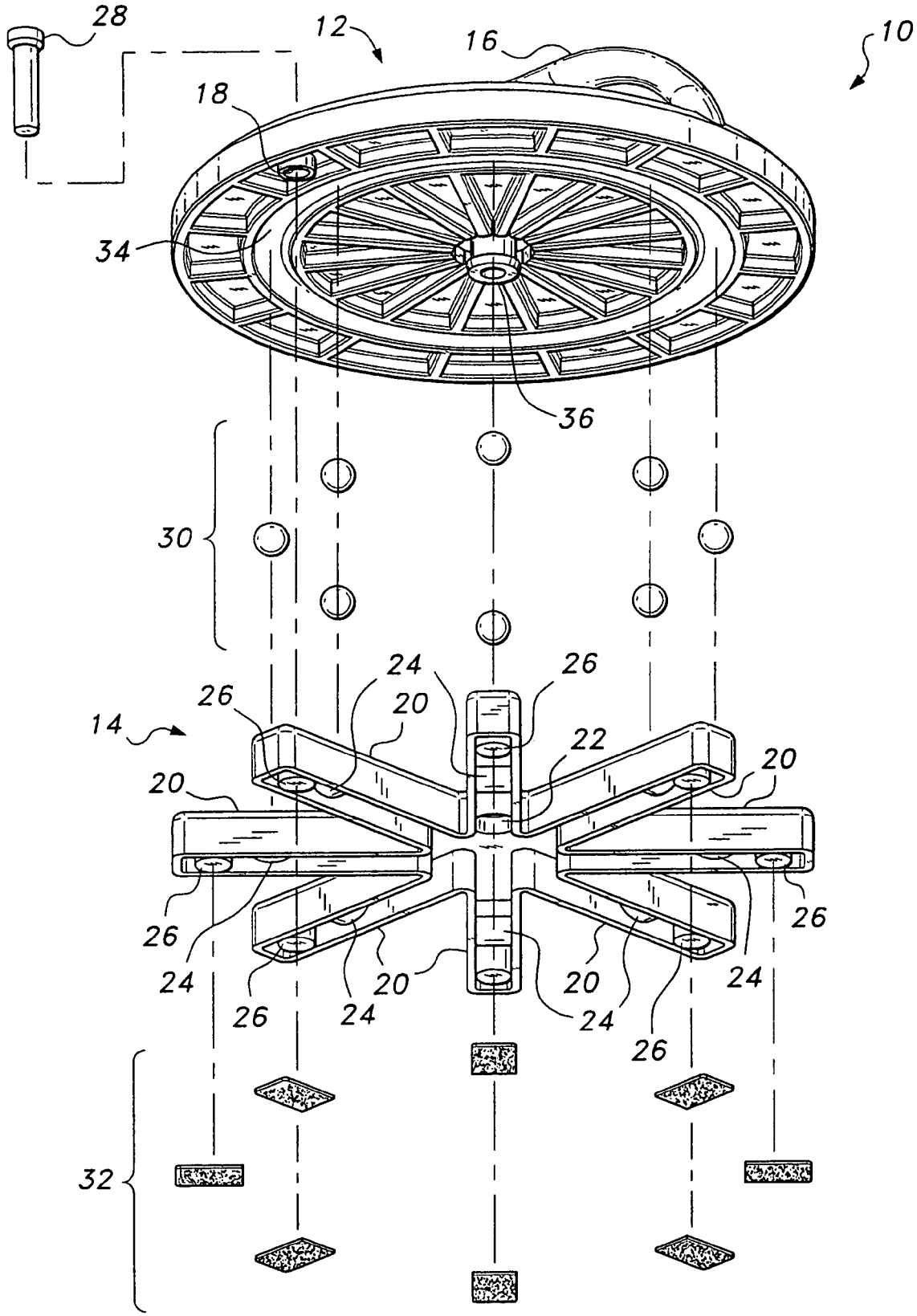
FIG. 4 is an exploded view of the rotatable push-up exercise device according to the present invention as seen from below.

The peripheral end of each support arm 20 includes a pair of recesses 24, 26 formed therein. As best shown in FIG. 4, a locking pin 28 is provided for selective reception within vertical passage 18 of platform 12, and one of the outer recesses 26. As described above with reference to FIG. 1, the user may utilize the rotatable mounting of platform 12 on base 14 to perform push-ups with the platform 12 either stationary or free to rotate. In order to keep the platform stationary, the user inserts locking pin 28 through passage 18 and into one of recesses 26, thus releasably and selectively holding platform 12 in place with respect to base 14, primarily to exercise the muscles of the arms and chest. The user may remove locking pin 28 to permit the platform 12 to rotate in order to perform rotation-based exercises in order to strengthen muscles in the shoulders and rotator cuff, as well as smaller muscles in the arms.

It will be obvious that in another variation, the user may selectively lock one device 10 to keep it stationary while permitting the second device 10 to rotate, thereby selectively exercising the rotator cuff muscles of one shoulder while maintaining the rotator cuff muscles of the other shoulder relatively constrained. Such a form of exercise may be particularly useful when exercising for rehabilitation of arm or shoulder injuries.

Figure 5:
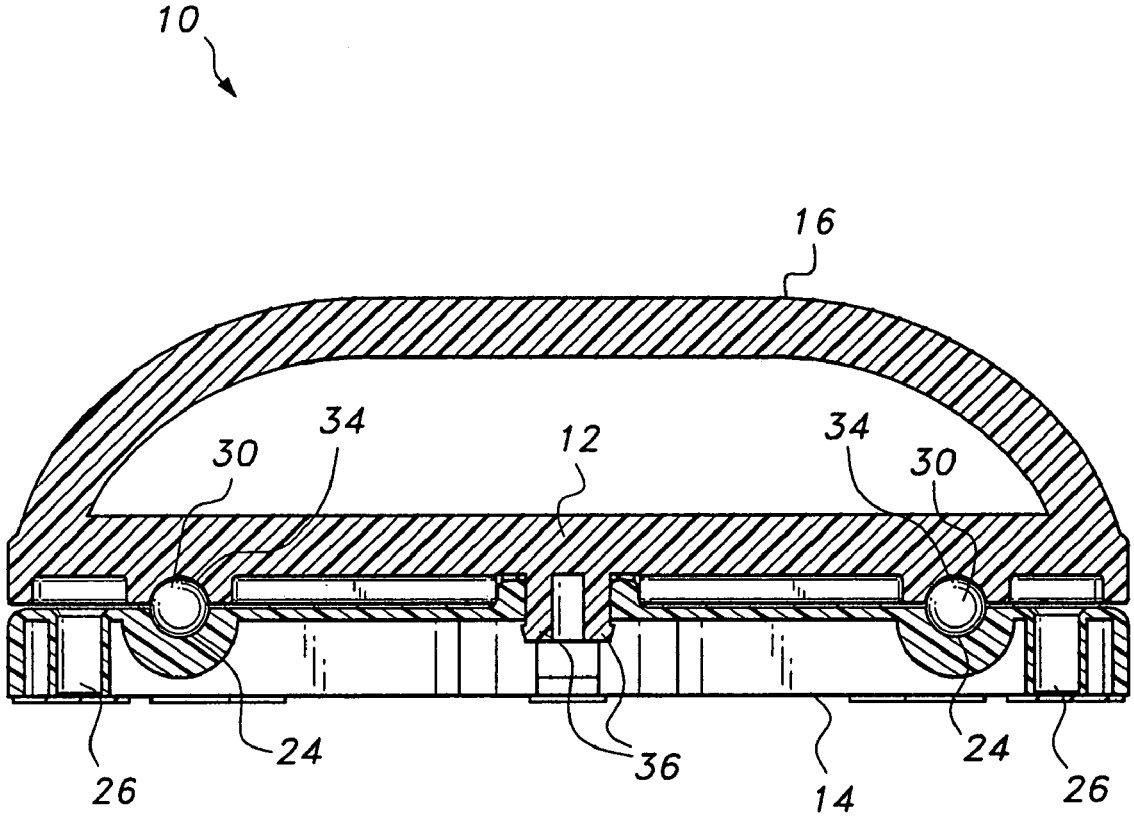
FIG. 5 is a side view of the rotatable push-up exercise device in section according to the present invention.

As shown in the section view of FIG. 5, the lower surface of platform 12 has an annular recess 34 formed therein. Annular recess 34 is aligned with recesses 24 of base 14, so that a plurality of ball bearings 30 may be positioned within recesses 24 and annular recess 34, annular recess 34 functioning as an upper bearing race. Each ball bearing is constrained within its corresponding recess 24, but is free to roll therein as platform 12 rotates, so that recesses 24 function as a separator and discontinuous lower race. Ball bearings 30 maintain smooth and stable rotation of platform 12 about base 14, resisting the downward thrust force from the weight of the user's upper body, as well as small radial forces that may be exerted due to an angle between the user's arms or shoulders that may not extend exactly normal to the floor through the platform 12. It should be understood that any suitable type of antifriction bearings or roller bearings may be utilized.

As further shown in FIG. 5, a plurality of locking fingers 36 are mounted centrally on the lower surface of platform 12 and project downwardly therefrom. Locking fingers 36 are relatively resilient and have a hook or lip at their free end, so that fingers 36 extend through opening 22 in hub 21, the hook or lip preventing the platform 12 from separating from base 14 but without being tight enough to prevent rotation of platform 12 with respect to base 14, i.e., sliding force between the fingers 36 and the platform opening 22 is minimal. It will be understood that any desired device may be used to rotatably secure the hub or central boss of platform 12 to the hub 21 of base 14, e.g., a bolt extending through a wheel bearing or plain bearing and being seated in a threaded boss depending from the platform 12.

Further, a plurality of frictional elements 32, which may be, for example, non-slip pads, may be applied to the lower surfaces of each support arm 20 The enhanced frictional engagement between base 14 and the support surface, such as the floor, will prevent accidental slippage between device 10 and the floor, which could cause the user injury.

It is to be understood that the present invention is not limited to the embodiment described above, but encompasses any and all embodiments within the scope of the following claims.

We claim:

1. A rotatable push-up exercise device, comprising:

a platform having an upper surface and a lower surface, the lower surface having an annular recess defined therein;

a gripping bar having opposed first and second ends attached to the upper surface of the platform, the gripping bar extending diametrically across the platform and being adapted for gripping by at least on hand of a user;

a base member having an upper surface and a lower surface, the lower surface being adapted for positioning on a support surface, the platform being rotatably mounted on the upper surface of the base member, the base having a central hub and a plurality of support arms extending radially from the central hub, each of the arms having a bearing recess defined therein; and a plurality of bearings corresponding in number to the support arms, each of the bearings being seated in a corresponding one of the bearing recesses and extending into the annular recess in the lower surface of the platform, the bearings rolling between the bearing recesses and the annular recess in order to reduce friction when the platform rotates.

* * * * *

UNITED STATES PATENT AND TRADEMARK OFFICE

CERTIFICATE OF CORRECTION

PATENT NO. : 7,481,753 B2
APPLICATION NO. : 11/654536
DATED : January 27, 2009
INVENTOR(S) : James et al.

It is certified that error appears in the above-identified patent and that said Letters Patent is hereby corrected as shown below:

On the Title page, Item 60 is inserted after (22) to read

-- (60) Related Application Data: Provisional Application US 60/771,014 filed February 8, 2006. --

Signed and Sealed this

Fourteenth Day of July, 2009

John Doll

JOHN DOLL
*Acting Director of the United States Patent and Trademark Office*